United States Patent [19]

Meyer

[11] Patent Number: 4,848,441

[45] **Date of Patent: * Jul. 18, 1989**

[54] METHOD OF ADJUSTMENT TO THE LEVEL OF THE LINE OF CONTACT BETWEEN THE FREE SURFACE OF THE METAL AND THE INGOT MOULD IN THE VERTICAL CASTING OF PRODUCTS OF ANY CROSS-SECTION

[75] Inventor: Jean-Luc Meyer, Voiron, France

[73] Assignee: Cegedur Societe de Transformation de l'Aluminium Pechiney, Paris, France

[ * ] Notice: The portion of the term of this patent subsequent to Feb. 9, 2005 has been disclaimed.

[21] Appl. No.: 143,010

[22] Filed: Jan. 12, 1988

[30] Foreign Application Priority Data

Jan. 15, 1987 [FR] France ..... 87 00815

[51] Int. Cl.[4] ..... B22D 27/02

[52] U.S. Cl. ..... 164/466; 164/502

[58] Field of Search ..... 164/466, 467, 468, 502, 164/503, 504

[56] References Cited

U.S. PATENT DOCUMENTS

| | | | |
|---|---|---|---|
| 4,216,817 | 8/1980 | Meier | 164/467 |
| 4,321,959 | 3/1982 | Yarwood et al. | 164/467 |
| 4,512,386 | 4/1985 | Haller | 164/467 |
| 4,606,397 | 8/1986 | Yarwood et al. | 164/467 |
| 4,723,591 | 2/1988 | Vives et al. | 164/466 |
| 4,735,255 | 4/1988 | Riquet | 164/502 |

*Primary Examiner*—Kuang Y. Lin

*Attorney, Agent, or Firm*—Dennison, Meserole, Pollack & Scheiner

[57] ABSTRACT

The invention relates to a method for adjusting the level of the line of contact between the mold and the free surface of the metal in the vertical continuous casting of products of any cross-section in an ingot-mold, which includes the step of applying to the solidifying metal, by means of an electric circuit surrounding the mold, a periodic magnetic field of variable intensity having a direction substantially parallel to the axis of the mold. According to the invention, the magnetic field applied to the mold is varied over a portion of the periphery of the metal. This can be done by modifying the distance between electric circuit creating the magnetic field and the mold, by changing the vertical positioning of the circuit, or by varying the shape of the profile of the circuit.

19 Claims, 2 Drawing Sheets

METHOD OF ADJUSTMENT TO THE LEVEL OF THE LINE OF CONTACT BETWEEN THE FREE SURFACE OF THE METAL AND THE INGOT MOULD IN THE VERTICAL CASTING OF PRODUCTS OF ANY CROSS-SECTION

The invention relates to a method of adjustment to the level of the line of contact between the free surface of metal and the ingot mould in the vertical casting of products of any cross-section.

During the production of semi-finished metallurgical products by the casting of ferrous or light metals such as aluminium and alloys thereof, a person skilled in the art attempts to obtain ingots, billets, plates etc. with the best possible physical and chemical homogeneity, in order to prevent the appearance of certain defects during subsequent transformation of these products into sheets, wires, etc.

The majority of casting methods currently employed in the industry give rise to the formation of greater or lesser defects in homogeneity during passage of the metal from the liquid state to the solid state, due essentially to different cooling conditions from one point to the other in the cast products. Thus, when casting using ingot moulds having a vertical passage where the metal is successively cooled indirectly by means of the ingot mould then directly by a wave of water, the presence of an external layer known as the "primary cortical layer" is observed on these semi-finished products. This layer, the structure and composition of which differ from those of the intenral portion of the semi-finished product, results from the indirect cooling of the metal when it makes contact with the ingot mould.

To eliminate this layer, attempts have therefore been made either to avoid any contacting between the metal and the ingot mould, as in the electromagnetic casting method forming the subject of the French patent No. 1 509 962, or to limit the height of contact with the ingot mould.

Within the scope of this limitation, French patent No. 2 570 304, of which the applicant is the proprietor, teaches a method for controlling the level of line of contact between the free surface of the metal and the ingot mould, which is characterised by the application to the solidifying liquid of a periodic magnetic field of variable intensity and having a direction substantially parallel to the axis of the ingot mould, the intensity of which is adapted as a function of the desired level.

This method allows production of a cortical layer having a thickness of substantially zero, a smooth skin and fine grain without prior addition of a refining agent such as AT5B for example, and is particularly suitable for circular section aluminium-based products such as billets.

However, in its application to products having a cross-section which is other than circular, and in particular, to large size rectangular plates, it has been found that the magnetic field does not have the same effect over the entire periphery of the product. In the casting of billets, the electric circuit which creates the magnetic field is given a contour which is equidistant from the ingot mold at all points, but when this is applied to shapes of other crosssections, the effect of the field is exacerbated on the small sides of the product, i.e. the small sides tend to become detached from the wall of the ingot mold before the large sides, and therefore the line of contact opposite the small sides is lower than the line of contact opposite the large sides. As disclosed in French Patent No. 2,570,304, the thickness of the cortical layer of the cast products depends on the position of the line of contact. As a result, the application of a uniform magnetic field to products of varied cross-section leads to a cortical layer of variable thickness and therefore to a heterogeneous product.

In order to overcome this asymmetry not only in the thickness of the cortical layer but also in the fineness of the grain and in the regularity of the skin, the applicant has provided a method which, within the scope of his above-mentioned patent is characterised in that the field applied to at least a fraction of the periphery of the metal is varied.

Thus, in contrast to the previous patent where the applied field was the same over the entire periphery of the metal at a given moment and could vary in time in its entirety to adjust the level to the desired height, in the present invention the value of the field applied to the metal is not the same over the entire periphery of the metal at a given moment but has differences in one or more fractions of said periphery.

This variation can be achieved, in particular, in three ways:

By modification of the distance between the electric circuit and the ingot mould, in view of the fact that this distance should be increased opposite the fraction of periphery, the level of which is to be raised, or reduced if, on the other hand, the level is to be lowered. In the case of a rectangular section ingot mould, the distance separating the circuit from the small sides of the ingot mould is preferably increased and this increase may be from one to two times the distance separating the circuit from the large sides, this latter distance being the one which has been fixed as base for operation during casting.

By changing the height position of the circuit relative to the ingot mould, that is to say that, once an optimum height has been determined, this height given the line of contact with the lowest ingot mould, all other things being equal, the portion of the circuit facing the fraction of periphery to be raised is moved upwards or downwards. This displacement is preferably by a height of at most half the actual height of the circuit. In the case of a rectangular section ingot mould, this displacement can be limited to the portion of the circuit facing the small sides.

By variation of the shape of the circuit profile, and preferably by a restriction to the side of the profile facing the ingot mold. Instead of being entirely straight, this side of the profile can have one or more curves which alternate or do not alternate with straight portions. In addition, the profile can have only straight portions, but one portion of which is vertical and another inclined. This inclination is preferably less than or equal to 45° to the vertical, and orient side of the profile away from the ingot mold.

In the case of a rectangular ingot mould, the solution involving having a circuit of which the profile side faciang the ingot mould is straight and vertical opposite the large sides is preferably adopted. Opposite the small sides of the ingot mould, the side of the profile is also straight but has a vertical portion at the top and an inclined portion at the bottom.

However, a circuit in which the side of the profile is vertical opposite the small sides of the ingot mould but has a portion which is inclined at the top and a vertical portion at the bottom opposite the large sides can also be used.

These three methods can be employed separately but also in combination with one another, or with other means such as the one involving increasing the height of the ingot mould on the small sides.

It is obvious that coils constituted by an enamelled copper wire, such as those described in French patent No. 2 570 304, are unsuitable for carrying out the method according to the invention. This is why the invention also comprises a variable electric circuit which allows modifications in distance, changes of height position and variations in the shape of the profile to be effected.

This circuit is characterised in that it is formed by a variable assembly of removable elongated elememts which can be adapted to the format of the cast product and are electrically interconnected, except at a point of the circuit where there is a discontinuity, on either side of which the areas for connection to a current source are placed.

Where only the distance between the circuit and the ingot mold is to be modified, the circuit elements can be straight or curved, of rectangular or square cross-section, and can be placed in the same horizontal plane. The circuit elements are interconnected such that when oriented in different directions, they allow the formation of a contour which is similar to that of the cast product. By displacement of the ends of the elements relative to one another, the appropriate distance between the element and the ingot mold is achieved.

If only the height position of the circuit is to be changed, these elements can have the configuration described above, with the difference that they are placed in at least two horizontal planes.

If the shape of the profile of the circuit is to be varied, the circuit can be formed from elements of suitable profile which are combined as above.

Depending on the intensity of the electric current circulating in these elements and of the resultant heating effect, a cooling system can be provided, for example by giving the elements a hollow shape so that a coolant can be circulated within them.

The elements can be inter-connected by any means known to a person skilled in the art which allows the circuit to be rendered variable and extendable as desired while maintaining a suitable electrical contact resistance between elements. This may be, for example, any screw and nut connecting system placed at the ends of the elements which are provided with elongated openings and inside which the screw bodies can slide, or alternatively any system of clips, jacks, connections by means of shoulders, or an open mortise and tenon system.

The invention will be understood better by reference to the following drawings.

Figure 1:
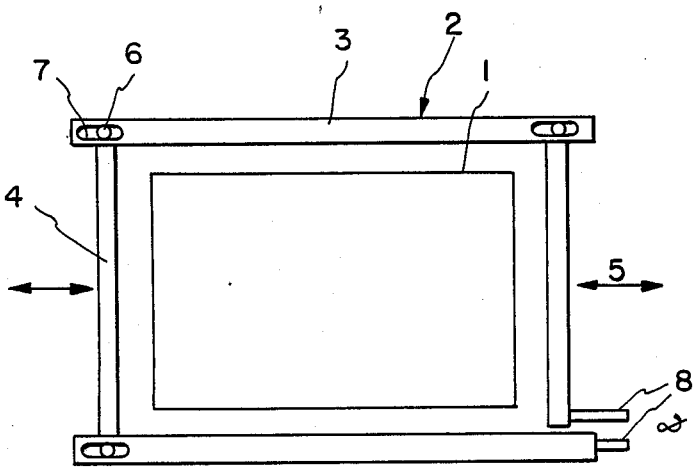
FIG. 1 shows a horizontal sectional view of a circuit containing an ingot mould of rectangular section and in which the distance between the circuit and the ingot mould is to be varied.

An ingot mould (1) of rectangular cross-section and a circuit (2) constituted by two elongated elements (3) resting on the ends of the elements (4) equipped with shoulders can be distinguished in FIG. 1. The elements (4) can be moved in the direction of the arrows (5) in order to increase the distance between the circuit and the ingot mould on the small sides of the ingot mould by means of nut and bolt systems (6) arranged in openings (7) of elongated shape located at the ends of the elements (3).

The facing ends of an element (3) and of an element (4) are electrically insulated and are equipped with areas (8) for connection to the current source.

Figure 2:
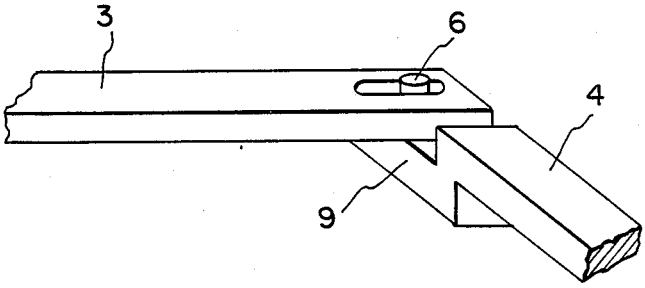
FIG. 2 shows a perspective view of the connection detail between two elements according to FIG. 1.

FIG. 2 shows a portion of element (4) equipped with a shoulder (9) on which there rests the end of an element (3), the two elements (3) and (4) being connected by means of a nut and bolt system (6). The shoulder is formed on element (4) such that the elements (3) and (4) of identical cross-section are located in the same horizontal plane.

Figure 3:
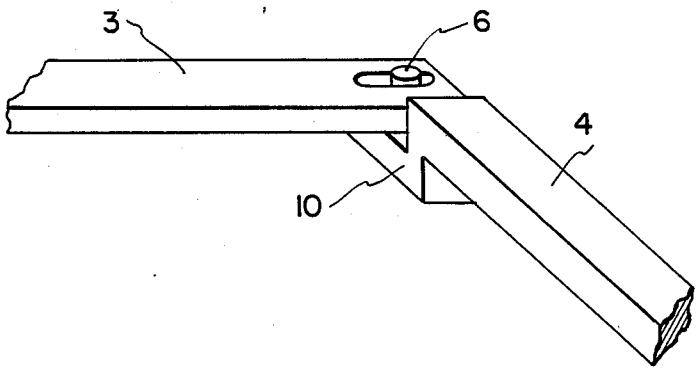
FIG. 3 shows a perspective view of the connecting detail between two elements when the height position of certain elements in the circuit is to be changed.

FIG. 3 shows that the shoulder (10) produced on the element (4) is higher than in FIG. 2 so that the element (3) is located in a different plane from the element (4) to which it is connected by the nut and bolt system (6).

Figure 4:
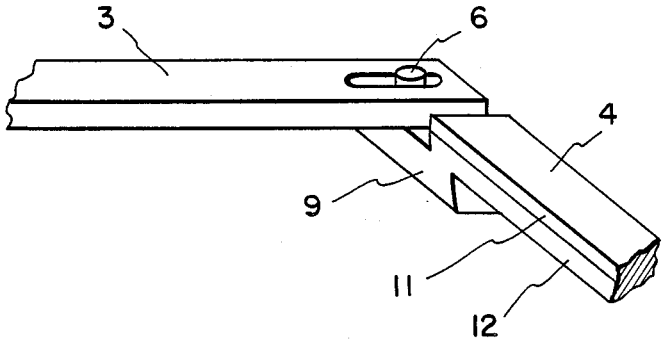
FIG. 4 shows a perspective view of the connection detail between two elements, where the profile of one of the elements is to be varied.

In FIG. 4, the element (4) has, on the side of its profile facing the ingot mould, a vertical portion (11) at the top and an oblique portion (12) at the bottom.

The invention can be illustrated by means of the following embodiment.

A rectangular ingot mould having dimensions of 1050 mm×460 mm was equipped with a circuit according to the invention comprising 4 copper elements having a cross-sectional area of 2000 $mm^2$, two of which have a length of 1177 mm and the other two a length of 634 mm.

The short elements were equipped with shoulders at their ends and were connected to the large bars, as indicated in FIG. 2, in order to have a distance of 20 mm between the ingot mould and long element and a distance of 35 mm between the ingot mould and the short element.

The ends of the elements placed at one of the vertices of the rectangle formed in this way were equipped with areas for the supply of electricity and were insulated from one another.

A plate composed of an aluminium alloy of the 1050 type according to the Aluminium Association standards was cast using this ingot mould, whereas the voltage at the teminals of the circuit was 5.28 volts. The product obtained was perfectly homogeneous.

The invention is used for the production of cast products having a thin cortical layer, a fine grain and a regular skin.

What is claimed is:

1. In the vertical continuous casting of metal products of any cross section in an ingot mold, including the step of applying to the solidifying metal, by means of an electric circuit surrounding the mold, a periodic magnetic field of variable intensity having a direction substantially parallel to the axis of the mold, a method for adjusting the level of the line of contact between the mold and the free surface of the metal comprising varying the applied magnetic field over a portion of the periphery of the metal.

2. A method according to claim 1, wherein the field is varied by varying the distance between the circuit and the ingot mould over a fraction of the periphery of the metal.

3. A method according to claim 1, wherein the field is varied by varying the height position of the circuit relative to the ingot mould over a fraction of the periphery of the metal.

4. A method according to claim 1, wherein the field is varied by varying the shape of the profile of the circuit over a fraction of the periphery of the metal.

5. A method according to claim 2, wherein said distance is increased in order to raise the level of said fraction.

6. A method according to claim 5, wherein said ingot mould is of rectangular cross-section having small sides and large sides, and the increase is made opposite the small sides.

7. A method according to claim 6, wherein increase is between 1 and 2 times the distance between the circuit and the large sides.

8. A method according to claim 3, wherein the varing is of a height at most equal to half the actual height of the circuit.

9. A method according to claim 8, wherein the ingot mould is of rectangular cross-section having small and large sides, and the position of the circuit is varied opposite the small sides.

10. A method according to claim 4, wherein the shape of the profile is varied only over the side of the profile facing the ingot mould.

11. A method according to claim 10, wherein the shape is varied by inclining said side over at least a portion of its length.

12. A method according to claim 11, wherein the inclination is less than or equal to 45° to the vertical.

13. A method according to claim 11, wherein the inclination directs the side of the profile away from the ingot mould.

14. A method according to claim 13, wherein said ingot mold is rectangular having large and small sides, and the inclination is limited to the fraction of length situated towards the bottom of said sides of the profile facing the small sides of the ingot mould.

15. A method according to claim 13, wherein said ingot mold is rectangular having large and small sides, and the inclination is limited to the fraction of length situated towards the top of the sides of the profile facing the large sides of the ingot mould.

16. An apparatus for continuous vertical casting of metal products of any cross section, comprising an ingot mold which contains and which is in contact with solidifying molten metal, and an electric circuit surrounding the mold which constitutes means for applying to the solidifying metal a magnetic field of variable intensity having a direction substantially parallel to the axis of the mold to vary the level of contact between the metal and the mold, said circuit comprising an assembly of elongated removable elements which are variable with respect to the mold and which are electrically interconnected except at a defined point in the circuit, and means located on both sides of said defined point for connection of the circuit to a source of electric current.

17. A circuit according to claim 16, wherein the elements have different lengths and/or profile cross-sections.

18. A circuit according to claim 16, wherein the elements are cooled.

19. A circuit according to claim 16, wherein the elements are located in different planes.

* * * * *